US006141509A

United States Patent [19]

Karasawa

[11] Patent Number: 6,141,509

[45] **Date of Patent: *Oct. 31, 2000**

[54] TONER CONTENT CONTROL DEVICE FOR AN ELECTROPHOTOGRAPHIC APPARATUS

[75] Inventor: Kazunori Karasawa, Tokyo, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/990,752

[22] Filed: Dec. 15, 1997

[30] Foreign Application Priority Data

Dec. 20, 1996 [JP] Japan ..... 8-355257

[51] Int. Cl.[7] ..... G03G 15/00

[52] U.S. Cl. ..... 399/58; 399/59; 399/60; 399/61; 399/62

[58] Field of Search ..... 399/49, 58, 59, 399/60, 61, 62, 63, 72, 64, 258

[56] References Cited

U.S. PATENT DOCUMENTS

| | | | |
|---|---|---|---|
| 4,942,431 | 7/1990 | Tada | 399/58 |
| 4,962,394 | 10/1990 | Sohmiya et al. | 399/60 |
| 4,991,998 | 2/1991 | Kamino et al. | 405/130 |
| 5,006,896 | 4/1991 | Koichi et al. | 399/74 |
| 5,038,175 | 8/1991 | Sohmiya | 399/58 |
| 5,500,720 | 3/1996 | Karasawa | 399/46 |
| 5,570,165 | 10/1996 | Koike | 399/58 |
| 5,857,131 | 1/1999 | Hasegawa | 399/46 |

FOREIGN PATENT DOCUMENTS

| | | |
|---|---|---|
| 3-148679 | 6/1991 | Japan . |
| 7-333967 | 12/1995 | Japan . |

*Primary Examiner*—Arthur T. Grimley
*Assistant Examiner*—William A. Noé
*Attorney, Agent, or Firm*—McDermott, Will & Emery

[57] ABSTRACT

A toner content control device for an electrophotographic apparatus of the type using a toner and carrier mixture. The control device determines an amount of toner replenishment on the basis of a difference between the toner content of the developer and a reference value, while correcting the reference value in accordance with the condition of a reference pattern formed on a photoconductive element. Although the control device includes a toner content sensor and a pattern density sensor, it omits conventional means for adjusting the toner content sensor. The control device is therefore capable of controlling image density stably with an inexpensive configuration.

4 Claims, 5 Drawing Sheets

| Vti | ΔTC |
|---|---|
| 1.0 | 0.2 |
| ⋮ | ⋮ |
| 2.0 | 0.04 |
| 2.1 | 0.05 |
| ⋮ | ⋮ |
| 3.0 | 0.2 |

Fig. 7 PRIOR ART

| P SENSOR OUTPUT (P) | P < a | a ≦ P < b | ------- | X < P |
|---|---|---|---|---|
| REFERENCE VALUE CORRECTION AMOUNT | Δ1 | Δ2 | | ΔX |

Fig. 8

| P SENSOR OUTPUT (P) | P < a | ------- | X < P |
|---|---|---|---|
| TONER CONTENT CORRECTION AMOUNT ( ΔTc) | tc1 | | tcx |

Δ = Δ (Vtp, tc)

Fig. 9 PRIOR ART

| Vref — Vt | a ---------- x |
|---|---|
| AMOUNT OF REPLENISHMENT (t) | t1 ---------- tx |

Fig. 10 tc = tc (Vt, Vref)

| DEVIATION OF TONER CONTENT | tc1 ---------- tcx |
|---|---|
| AMOUNT OF REPLENISHMENT | t1 ---------- tx |

TONER CONTENT CONTROL DEVICE FOR AN ELECTROPHOTOGRAPHIC APPARATUS

BACKGROUND OF THE INVENTION

The present invention relates to an electrophotographic apparatus of the type using a two-ingredient type developer, i.e., toner and carrier mixture. More particularly, the present invention is concerned with a toner content control device for determining an amount of toner replenishment on the basis of a difference between the toner content of a developer and a reference value, while correcting the reference value in accordance with the condition of a reference pattern formed on a photoconductive element.

An important question with an electrophotographic apparatus of the type described is how the toner content of a developer should be controlled. Japanese Patent Laid-Open Publication No. 1-154179, for example, teaches a toner content control method using a toner content sensor and replenishing toner in such a manner as to maintain a toner content constant. It has been customary with this kind of method to add some circuit for reducing the scattering of the output of the toner content sensor and thereby confining the sensor output in a preselected range.

However, the conventional approach for maintaining the toner content constant has a problem that for a given toner content the density of an image output by the electrophotographic apparatus changes, depending on ambient temperature and humidity and conditions in which the developer is used. This problem is particular to electrophotography which develops a latent image by charging toner by friction.

To solve the above problem, a reference pattern may be formed on a photoconductive element so as to replenish toner such that the density of the reference pattern remains constant, as proposed in the past. Even this kind of scheme has the following problems left unsolved. When the toner content should be noticeably increased in order to guarantee a pattern density in accordance with humidity and temperature and the conditions of use, it is likely that the toner cannot be sufficiently charged and shoots out of a developing unit, smearing the inside of the apparatus. Conversely, when the toner content should be noticeably reduced, the carrier is apt to deposit on the photoconductive element and bring about a trouble. In such a case, it is preferable to confine the toner content in a certain range although the pattern density may slightly deviate from a target density.

In light of the above, there has been proposed to use, in combination with the toner content sensor, a pattern density sensor responsive to the density of a reflection from a reference pattern formed on a photoconductive element. This kind of technology is disclosed in, e.g., Japanese Patent Laid-Open Publication No. 2-34877. Specifically, toner is usually so replenished as to maintain the toner content constant in response to the output of the toner content sensor. A reference pattern is formed at preselected intervals or every time a preselected number of copies are produced, while the pattern density sensor senses the density of the reference pattern. A reference value for control and assigned to the toner content sensor is varied in accordance with the sensed pattern density. A reference value associated with the upper and lower limits of toner content is selected beforehand. The reference value is so controlled as not to lie outside of the range between the upper and lower limits even if the pattern density is deviated from a target density. With this scheme, it is possible to implement an electrophotographic apparatus ensuring stable image density.

While the above conventional scheme is capable of stably controlling the image density, it is costly due to the two sensors, i.e., toner content sensor and pattern density sensor. That is, not only the individual sensor is costly, but also an adjusting circuit for the initial setting of the toner content sensor increases the cost.

To reduce the cost, the initial adjustment of the toner content sensor may be omitted. However, if the initial adjustment is simply omitted, then the output of the toner content sensor is scattered with respect to the toner content and makes it impracticable to set the initial reference value and upper and lower limits of the toner content. Moreover, the output curve of the toner content sensor includes a zone in which the sensor output varies only slowly with respect to the varying toner content, i.e., the sensor sensitivity is low. In such a zone, the control itself is impracticable. This is why an adjusting circuit for the initial adjustment has customarily been added to the toner content sensor, at least when pattern density sensor is used in combination with the toner content sensor.

Other conventional approaches for toner density control are disclosed in, e.g., Japanese patent Laid-Open Publication Nos. 3-148679 and 7-333967.

SUMMARY OF THE INVENTION

It is therefore an object of the present invention to provide a toner content control device using a toner content sensor and a pattern density sensor, but having an inexpensive configuration not including toner content sensor adjusting means and capable of controlling image density stably.

It is another object of the present invention to provide a toner content control device capable of surely preventing toner content from increasing to an excessive degree.

It is another object of the present invention to provide a toner content control device using a toner content sensor and a pattern density sensor, but having an inexpensive configuration not including toner content sensor adjusting means and capable of correcting a toner density reference value rapidly neither too much nor too less in accordance with the output of the pattern density sensor, thereby ensuring stable image density.

It is another object of the present invention to provide a toner content control device using a toner content sensor and a pattern density sensor, but having an inexpensive configuration not including toner content sensor adjusting means and capable of maintaining the amount of toner replenishment determined on the basis of the output of the toner content sensor adequate at all times, thereby preventing toner from flying about due to excessive replenishment and ensuring stable image density.

In accordance with the present invention, a toner content control device for an electrophotographic apparatus includes a toner content sensor for sensing the toner content of a developer existing in a developing unit in terms of the permeability of the developer. A pattern density sensor senses the density of a reference pattern formed on a photoconductive element. A controller determines, during usual operation, the amount of toner to be replenished on the basis of a difference between the output of the toner content sensor and a reference value, and forms, at a preselected timing, the reference pattern on the photoconductive element, detects the density of the reference pattern via the pattern density sensor, and corrects the reference value in accordance with the density detected. Further, the controller drives the developing unit just after the replacement of the developer in order to detect the resulting output of the toner content sensor, determines an upper limit and a lower limit of the reference value on the basis of the output of the toner content sensor, and corrects the reference value in response to the output of the pattern density sensor within a range of from the upper limit to the lower limit up to the next replacement of the developer.

Also, in accordance with the present invention, a toner content control device for an electrophotographic apparatus includes a toner content sensor for sensing the toner content of a developer existing in a developing unit in terms of the permeability of the developer. A pattern density sensor senses the density of a reference pattern formed on a photoconductive element. A controller determines, during usual operation, the amount of toner to be replenished on the basis of a difference between the output of the toner content sensor and a reference value, and forms, at a preselected timing, the reference pattern on the photoconductive element, detects the density of the reference pattern via the pattern density sensor, and corrects the reference value in accordance with the density detected. Further, the controller corrects the reference value on the basis of sensitivity compensation data produced from the output of the toner content sensor appearing when the pattern density sensor senses the reference pattern.

Further, in accordance with the present invention, a toner content control device for an electrophotographic apparatus includes a toner content sensor for sensing the toner content of a developer existing in a developing unit in terms of the permeability of the developer. A pattern density sensor senses the density of a reference pattern formed on a photoconductive element. A controller determines, during usual operation, the amount of toner to be replenished on the basis of a difference between the output of the toner content sensor and a reference value, and forms, at a preselected timing, the reference pattern on the photoconductive element, detects the density of the reference pattern via the pattern density sensor, and corrects the reference value in accordance with the density detected. Further, the controller corrects a determined amount of toner replenishment on the basis of sensitivity compensation data produced from the output of the toner content sensor.

BRIEF DESCRIPTION OF THE DRAWINGS

The above and other objects, features and advantages of the present invention will become apparent from the following detailed description taken with the accompanying drawings in which:

FIG. 7 shows a data table particular to a conventional toner content control device and showing a relation between the output of a pattern density sensor and a reference correction amount;

FIG. 8 shows a data table representative of another alternative embodiment of the present invention and listing a relation between the output of a pattern density sensor and a toner content correction amount;

FIG. 9 shows a data table particular to a conventional toner content control device and listing a relation between a difference between the output of a toner content sensor and a reference value and the amount of toner replenishment; and FIG. 10 shows a data table representative of still another alternative embodiment of the present invention and listing a relation between the deviation of a toner content from a reference value and the amount of toner replenishment.

DESCRIPTION OF THE PREFERRED EMBODIMENTS

Figure 1:
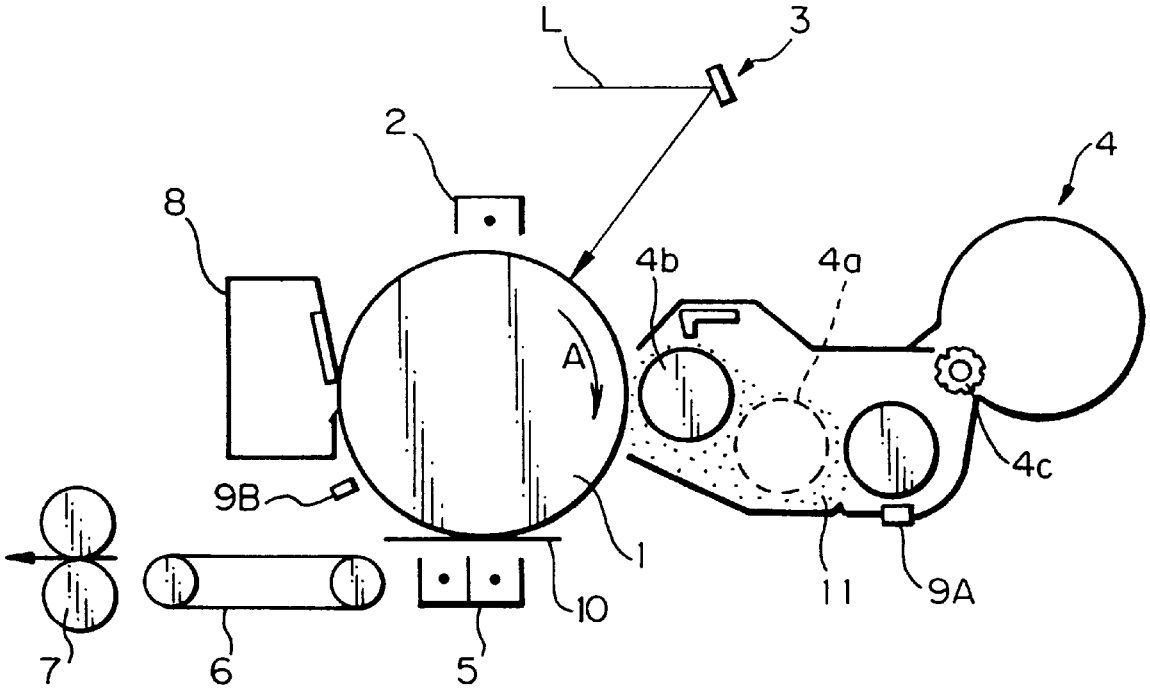
Fig. 1 (PRIOR ART)
FIG. 1 is a fragmentary section showing an image forming system included in an electrophotographic apparatus.

To better understand the present invention, brief reference will be made to an electrophotographic apparatus including a conventional toner content control device, shown in FIG. 1. As shown, the apparatus, particularly an image forming system thereof, includes a photoconductive element implemented as a drum 1. A charger 2, optics 3 for exposure, a developing unit 4, an image transfer unit 5, a conveying mechanism 6, a fixing unit 7 and a cleaning unit 8 are sequentially arranged around the drum 1 in the order of an image forming process.

While the drum 1 is rotated in the direction indicated by an arrow A in FIG. 1, the charger 2 uniformly charges the surface of the drum 1 to a preselected potential. A laser beam L issuing from the optics 3 writes an image on the charged surface of the drum 1 in accordance with an image signal. Specifically, the resistance of the surface of the drum 1 decreases when the drum is illuminated. Therefore, the portion of the drum 1 illuminated by the laser beam L has its potential decreased with the result that a latent image is electrostatically formed on the drum 1. The latent image is developed by the developing unit 4.

The developing unit 4 stores a two-ingredient type developer 11, i.e., toner and carrier mixture. An agitator 4*a* is disposed in the developing unit 4 in order to agitate the developer 11. As a result, the toner is frictionally charged by the carrier. The charged toner is conveyed together with carrier to a developing roller 4*b* also positioned in the developing unit 4. Consequently, the toner is electrostatically transferred from the developing roller 4*b* to the latent image carried on the drum 1.

A toner image produced by the developing unit 4 is transferred from the drum 1 to a paper or similar recording medium 10 by the image transfer unit 5. The conveying unit 6 conveys the paper 10 carrying the toner image to the fixing unit 7. After the toner image has been fixed on the paper 10 by the fixing unit 7, the paper 10 is driven out of t he apparatus. The cleaning unit 8 removes some toner which remains on the drum 1 after the image transfer. Such a procedure is repeated to sequentially form toner images on consecutive papers.

Figure 2:
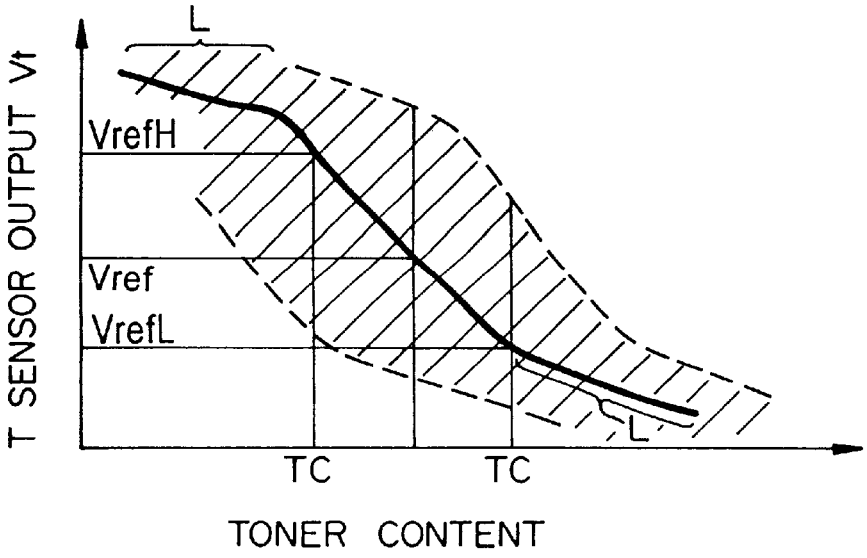
FIGS. 2 and 3 are graphs each showing a particular characteristic of a toner content sensor.

The conventional toner content control device is implemented by a toner content sensor 9A and a pattern density sensor 9B. The toner content of the developer 11 existing in the developing unit 4 sequentially decreases due to the repeated image forming operation. The toner content sensor (T sensor hereinafter) 9A senses the varying toner content of the developer 11 present in the developing unit, using the fact that the permeability of the developer 11 changes with a change in toner content. FIG. 2 shows a relation between the toner content and the output Vt of the T sensor 9A. As FIG. 2 indicates, a necessary amount of toner to be replenished can be determined on the basis of a difference between a reference voltage Vref corresponding to a desired toner content and the output Vt of the T sensor 9A, i.e., Vref−Vt.

If a toner replenishing device 4*c* included in the developing unit 4 is driven to replenish the above necessary amount of toner, the toner content of the developer 11 in the unit 4 can be maintained constant. between an upper and a lower dotted line shown in FIG. 2 (indicated by hatching). In light of this, a preselected reference pattern is formed on the drum 1 at a preselected timing, e.g., every time a preselected number of copies are produced. The pattern density sensor (P sensor hereinafter) 9B senses the density of a toner image produced by developing the above reference pattern. Then, the amount of toner to be replenished to the developing device 4 i s controlled on the basis of the sensed density of the toner image. Before the advent of this kind of toner content control device, an adjusting circuit was added to the T sensor 9A so as to allow a serviceman to adjust the sensor 9A at the time of loading of a new developer such that a characteristic curve indicated by a solid line in FIG. 2 was set up. The P sensor 9B is made up of a light emitting element for illuminating the drum 1 and a light-sensitive element for receiving the resulting reflection from the drum 1. The P sensor 9B is driven in synchronism with the reference pattern forming timing.

A controller or CPU (Central Processing Unit), not shown, determines the timing for forming the reference pattern and the timing for driving the P sensor 9B. For example, when images are formed on a preselected number of consecutive papers 10, the controller determines that the reference pattern should be formed. Then, the controller controls the image forming system so as to form the reference pattern on the drum 1 and to cause the P sensor 9B to sense the density of the reference pattern. Specifically, the laser beam L from the optics 3 forms a latent image pattern having a preselected size on the drum 1 having been uniformly charged by the charger 2. The developing unit 3 develops the latent image pattern and thereby produces a corresponding reference pattern. While the image transfer unit 5 is held inoperative, the reference pattern is conveyed by the drum 1 toward the P sensor 9B via the image transfer position. When the reference pattern moves in front of the P sensor 9B, the P sensor 9B senses the density of the reference pattern on the basis of the intensity of reflection from the toner constituting the pattern.

If the density of the reference pattern sensed by the P sensor 9B is lower than a target density, the controller shifts a reference value assigned to the T sensor 9A in a direction in which the toner content increases. If the sensed density is higher than the target density, the controller shifts the reference value of the T sensor 9A in a direction in which the toner content decreases. In this manner, the controller is capable of maintaining the density of the reference pattern and therefore that of the output image constant.

It has been customary to determine how much the reference value of the T sensor 9A should be shifted with respect to the output of the P sensor 9B, as follows. Use is made of a memory storing a data table, or look-up table, based on the results of experiments. The reference value of the T sensor 9A (or the correction value of the same) is determined with respect to the output of the P sensor 9B by referencing the data table. To prevent the toner content from increasing or decreasing excessively, the reference value of the T sensor 9A is prevented from being shifted to the outside of a preselected range.

While the above conventional toner content control device is capable of controlling the image density stably, it is costly due to the two sensors, T senor 9A and P senor 9B. That is, not only the individual sensor is costly, but also the adjusting circuit for the initial setting of the T sensor 9A increases the cost.

The present invention successfully reduces the cost of the toner content control device by omitting the above adjusting circuit. However, if the adjusting circuit is simply omitted, then the output of the T sensor 9A is scattered with respect to the toner content and makes it impracticable to set the initial reference value and upper and lower limits of the toner content. Moreover, as shown in FIG. 2, the output curve of the T sensor 9A includes zones L in which the sensor output varies only slowly with respect to the varying toner content, i.e., the sensor sensitivity is low. In such a zone L, the control itself is impracticable. This is why the adjusting circuit has customarily been added to the T sensor 9A, at least when P sensor 9B is used in combination with the T sensor 9A.

However, extended researches and experiments on the output characteristic of the T sensor 9A showed that despite the above zones L in which the sensor output varies only slowly, the toner content can be sufficiently determined with the T sensor 9A. The present invention is derived from this finding.

Preferred embodiments of the toner content control device in accordance with the present invention will be described hereinafter.

A preferred embodiment to be described is based on the conventional toner content control device using the T sensor 9A and P sensor 9B, usually determining the amount of toner replenishment on the basis of a difference between the output of the T sensor 9A and the reference value, and selectively forming the reference pattern and causing the P sensor 9B to sense the density of the reference pattern so as to correct the reference value, as stated earlier. In the illustrative embodiment, just after the loading of a new developer, the developing device 4 is driven in order to detect the output Vti of the T sensor 9A. Then, an upper limit VrefH and a lower limit VrefL of the reference value Vref are determined on the basis of the sensor output Vti. Up to the next replacement of the developer, the reference value Vref is corrected within the range of from VrefH to VrefL in accordance with the output of the P sensor 9B.

Figures 3, 5:
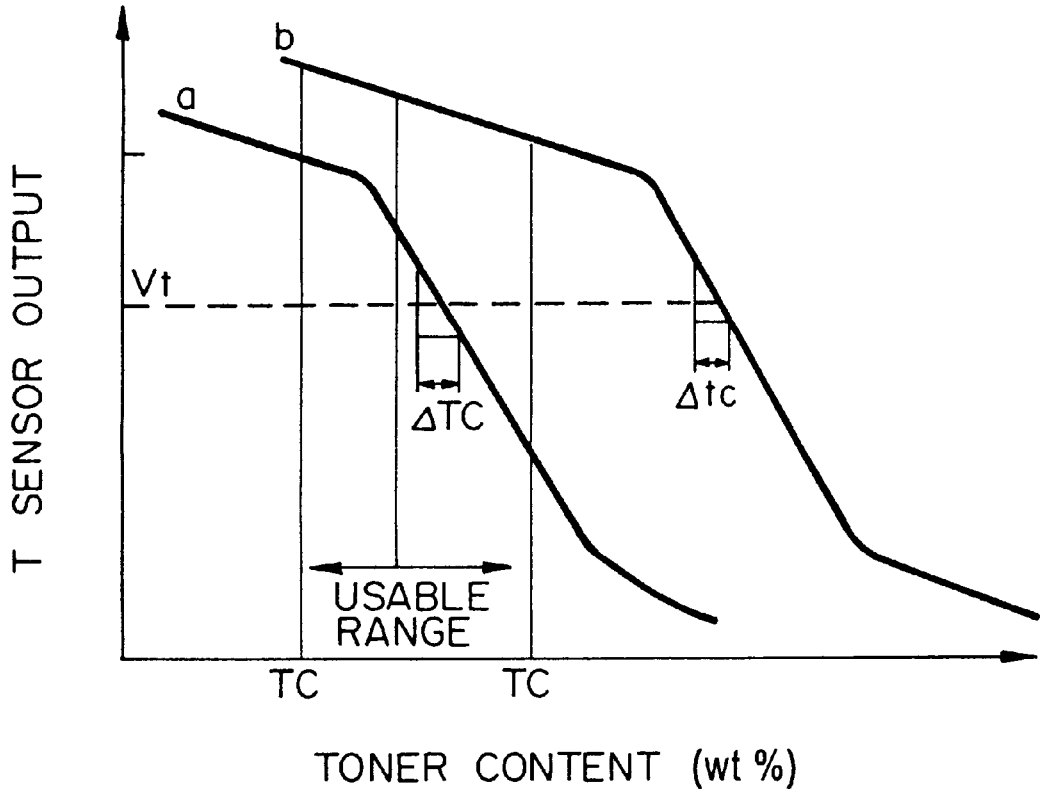
FIG. 5 shows a specific data table listing a relation between the output of a toner content sensor and the variation of toner content.

Specifically, as shown in FIG. 3, the toner content and the output of the T sensor, whether its characteristic be a or b, have a gradient determined substantially by the T sensor 9A output Vti appearing when a new developer is loaded. The illustrative embodiment corrects, based on the T sensor 9A output Vti just after the loading of a new developer, the correction amount of the reference value using the output of the P sensor 9B, the amount of toner replenishment, and the upper and lower limits VrefH and VrefL of the output of the T sensor 9A.

Figure 4:
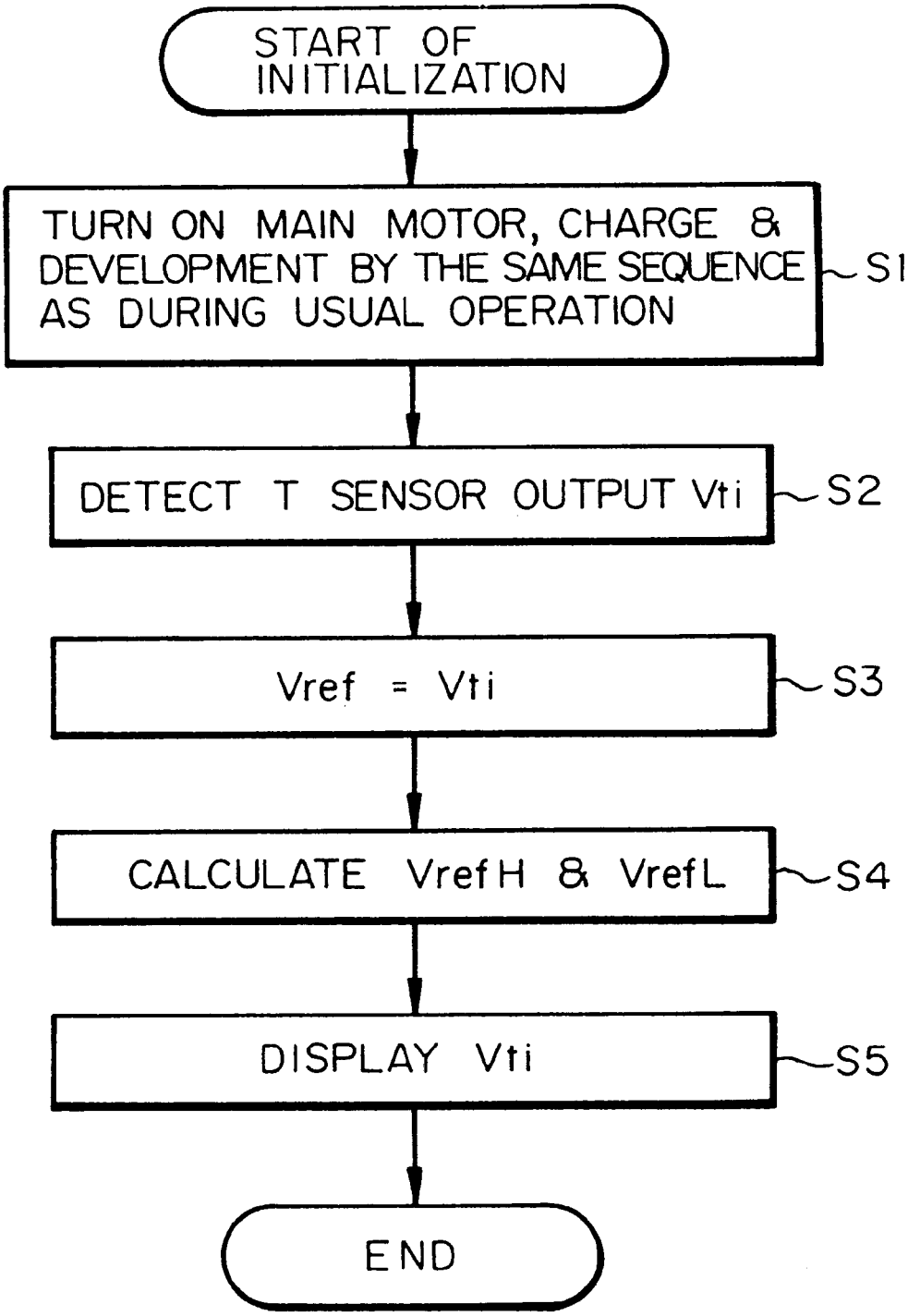
FIG. 4 is a flowchart demonstrating an initialization procedure particular to an embodiment of the present invention.

FIG. 4 demonstrates an initialization procedure in which the main motor, charger, developing unit and other constituents of the image forming apparatus are rendered operable by the same sequence as during usual operation (step S1). It has been customary to adjust the output of the T sensor 9A to a preselected value at this initializing step. By contrast, this embodiment detects the output Vti of the T sensor 9A just after the loading of a new developer, but does not execute any adjustment (step S2). Then, a reference value Vref equal to the output Vti of the T sensor 9A is set up (step S3). FIG. 5 shows a specific data table determined by experiment listing T sensor 9A outputs. Vti and toner density variations ΔTC each occurring in the range of ±0.05 V of the respective sensor output Vti. After the step S3, an upper limit VrefH and a lower limit VrefL of the reference value Vref of the T sensor 9A are determined with reference to the data table of FIG. 5, i.e., by calculating the outputs of the T sensor 9A deviated from the above sensor output Vti by a given amount (step S4). For example, assume that the output Vti of the T sensor 9A at the time of initialization is 2 V, and that a toner content 1% higher than the toner content at the time of initialization is desired as an upper limit. Then, the output Vti of the T sensor 9A corresponding to the desired upper limit of toner content is calculated on the basis of ΔTC corresponding to Vti=2 V. The resulting sensor output Vti is selected to be an upper limit VrefH. A lower limit VrefL is determined in the same manner as the upper limit VrefH. The upper limit VrefH and lower limit VrefL are written to a RAM (Random Access Memory), not shown, and displayed on, e.g., a control panel (not depicted) provided on the apparatus (step S5). This is followed by usual operation.

During usual operation, the reference value Vref is corrected within the range of from VrefH to VrefL on the basis of the output of the P sensor 9B up to the next replacement (loading) of the developer.

An alternative embodiment of the present invention will be described which is also implemented as a toner density control device of the type described. In the alternative embodiment, a new developer to be loaded in the apparatus has the maximum toner content applicable to the apparatus, and the upper limit VrefL defining the upper limit of toner content the output Vti of the T sensor 9A are equalized.

Figure 6:
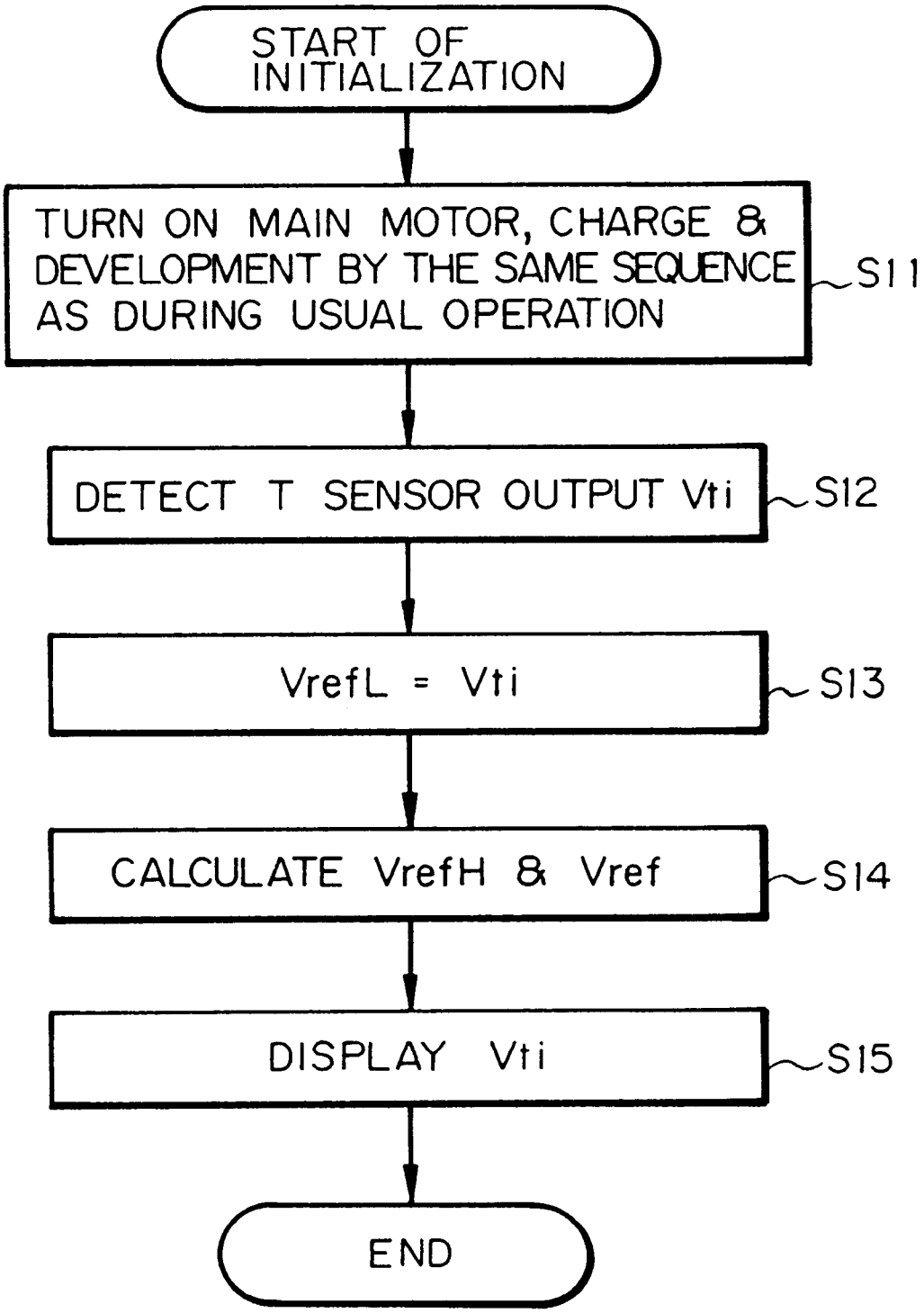
FIG. 6 is a flowchart showing an initialization procedure representative of an alternative embodiment of the present invention.

FIG. 6 shows an initialization procedure particular to the alternative embodiment. As shown, the main motor, charger, developing unit and other constituents of the apparatus are rendered operable by the same sequence as during usual operation (step S11). Then, the output Vti of the T sensor 9A just after the loading of a new developer is detected (step S12). The detected sensor output Vti is selected to be the lower limit VrefL of the reference value Vref (step S13). Subsequently, a reference value Vref and an upper limit VrefH are calculated with reference to the data table of FIG. 5 (step S14). The calculated reference value Vref and upper limit VrefH are written to the RAM, not shown, and displayed on the control panel of the apparatus (step S15). This is followed by usual operation.

With the procedure described with reference to FIG. 6, it is possible to reduce the error of the upper limit of toner content at the time of initialization. Although such a procedure slightly increases the toner content for some time after the initialization, a high toner content does not matter at all so long as the toner is not replenished. If desired, a toner consuming mode may be set after the initialization in order to forcibly cause the apparatus to consume toner until an adequate toner content has been reached.

Another alternative embodiment of the present invention is as follows. To correct the reference value Vref of the T sensor 9A on the basis of the output of the P sensor 9B, it has been customary to use a data table shown in FIG. 7 and listing the outputs of the P sensor 9B and the correction amounts of the reference value Vref respectively corresponding the sensor outputs. Specifically, the data table shows how much the reference value Vref should be shifted, or corrected, with respect to the output of the P sensor 9B, i.e., correction amounts Δ determined by experiments; Δ denotes a fixed value. This conventional scheme is effective only if the relation between the output Vt of the T sensor 9A and the toner content is constant, as indicated by a solid line in FIG. 2. That is, this kind of scheme is not effective if the above relation is not constant, e.g., if the relation depends on the sensor or the conditions of use, as indicated by the curves a and b in FIG. 3. This is because the variation ΔTC of the toner content with respect to the variation of the output of the T sensor 9A, i.e., the gradient of the characteristic curve varies.

In this alternative embodiment, desirable variations ΔTC of toner content determined by experiments are substituted for the correction amounts Δ of the reference value Vref of the T sensor 9A. The desirable variations ΔTC are listed in a data table shown in FIG. 8 and adapted for sensitivity compensation. An output Vtp which the T sensor 9A produces when the P sensor 9B senses a pattern density is determined by use of the data table of FIG. 5. Then, a desirable variation of the reference value Vref of the T sensor 9A is determined by referencing the data table of FIG. 8 with the T sensor 9A output Vtp. For example, assume that the output Vtp of the T sensor 9A appearing when the P sensor 9B senses a pattern density is 2 V, and that it is desired to increase the toner content by 0.1%. Then, the output of the T sensor 9A corresponding to the 0.1% higher toner content is calculated on the basis of ΔTC of FIG. 5 corresponding to Vti=2 V. A difference between Vti corresponding to the 0.1% higher toner content and Vtp is determined to be the desirable correction amount of the reference value Vref of the T sensor 9A.

By varying the correction amount of the reference value Vref in accordance with the instantaneous output sensitivity of the T sensor 9A, as stated above, it is possible to correct the reference value in accordance with the output of the P sensor 9B even in the range in which the sensitivity of the T sensor 9A has varied. This guarantees stable image density.

Still another alternative embodiment of the present invention will be described hereinafter. FIG. 9 shows a data table listing a relation between the difference between the output and the reference value of the T sensor 9A, i.e., Vref−Vt and the duration of drive t of the toner replenishing device 4*c* and customarily used to control the replenishment of toner to the developing device 4. However, this kind of scheme, like the previously stated conventional scheme, is not effective if the relation between the T sensor 9A output and the toner content is not constant.

In this alternative embodiment, a deviation of toner density is determined on the basis of the value of a difference between the output Vt of the T sensor 9A and the reference value Vref. The duration of drive t of the toner replenishing device 4*c* is determined by using the above deviation with reference to a data table shown in FIG. 10. The data table of FIG. 10 is adapted for sensitivity compensation and determined by experiments. For example, assume that when the reference value Vt is 2 V, the output of the T sensor 9A is 2.1 V. Then, the deviation of toner density is (0.05+0.04)/2=0.045%, as determined by the data table of FIG. 5. With this deviation, it is possible to determine a duration of drive t with reference to the data table of FIG. 10. Alternatively, the period of time t may be produced from the deviation of toner content on the basis of a given amount of developer and the ability of the replenishing device 4*c*. However, the experimentally determined look-up table should preferably be used in order to obviate the excessive replenishment of the toner and the fall of image density.

As stated above, when the amount of toner replenishment determined by the output of the T sensor 9A is varied in accordance with the instantaneous output sensitivity of the T sensor 9A, the toner can be replenished in an adequate amount at all times. This successfully prevents the toner from flying about due to excessive replenishment and guarantees stable image density.

In summary, it will be seen that the present invention provides a toner content control device for an electrophotographic apparatus and having various unprecedented advantages, as enumerated below.

(1) The control device, although using a toner content sensor and a pattern density sensor, drives a developing unit just after the loading of a new developer in order to detect the resulting output Vti of the toner content sensor. The control device determines, based on the sensor output Vti, an upper limit VrefH and a lower limit VrefL of a reference value Vref and corrects Vref within the range of from VrefH to VrefL in accordance with the output of the pattern density sensor up to the next replacement of the developer. The control device is therefore capable of controlling image density stably with an inexpensive configuration not needing toner content sensor adjusting means.

(2) A new developer has the maximum toner content applicable to the apparatus, and VrefL defining the upper limit of toner content and the output Vti of the toner content sensor are equalized. This surely prevents the toner content from being excessively increased.

(3) The control device, although using the toner content sensor and pattern density sensor, corrects the reference value of the toner content sensor on the basis of sensitivity compensation data derived from the output of the toner content sensor appearing when the pattern density sensor senses a density pattern. The control device is therefore capable of performing adequate correction of the reference value rapidly with an inexpensive configuration not needing toner content sensor adjusting means. This guarantees stable image density.

(4) The control device, although using the toner content sensor and pattern density sensor, corrects the determined amount of toner replenishment to the developing device on the basis of sensitivity correction data derived from the output of the toner content sensor. The control device is therefore capable of replenishing the toner in an adequate amount determined by the output of the toner content sensor with an inexpensive configuration not needing toner content sensor adjusting means. This prevents the toner from flying about due to excessive replenishment and ensures stable image density.

Various modifications will become possible for those skilled in the art after receiving the teachings of the present disclosure without departing from the scope thereof.

What is claimed is:

1. A toner content control device for an electrophotographic apparatus, comprising:

a toner content sensor for sensing a toner content of a developer existing in a developing unit in terms of a permeability of the developer;

a pattern density sensor for sensing a density of a reference pattern formed on a photoconductive element; and control means for determining, during usual operation, an amount of toner to be replenished on the basis of a difference between an output of said toner content sensor and a reference value, and for forming, at a preselected timing, the reference pattern on the photoconductive element, detecting a density of the reference pattern via said pattern density sensor, and correcting said reference value in accordance with the density detected;

said control means driving the developing unit just after a replacement of the developer in order to detect a resulting output of said toner content sensor, determining an upper limit and a lower limit of said reference value on the basis of the output of said toner content sensor, and correcting said reference value in response to the output of said pattern density sensor within a range of from said upper limit to said lower limit up to a next replacement of the developer.

2. A device as claimed in claim 1, wherein the developer has a maximum toner content applicable to said photoconductive element, and wherein said upper limit defining an upper limit of toner content and the output of said toner content sensor are equalized.

3. A toner content control device for an electrophotographic apparatus, comprising:

a toner content sensor for sensing a toner content of a developer existing in a developing unit in terms of a permeability of the developer;

a pattern density sensor for sensing a density of a reference pattern formed on a photoconductive element; and control means for determining, during usual operation, an amount of toner to be replenished on the basis of a difference between an output of said toner content sensor and a reference value, and for forming, at a preselected timing, the reference pattern on the photoconductive element, detecting a density of the reference pattern via said pattern density sensor, and correcting said reference value in accordance with the density detected;

said control means correcting said reference value on the basis of sensitivity compensation data produced from the output of said toner content sensor appearing when said pattern density sensor senses the reference pattern.

4. A toner content control device for an electrophotographic apparatus, comprising:

a toner content sensor for sensing a toner content of a developer existing in a developing unit in terms of a permeability of the developer;

a pattern density sensor for sensing a density of a reference pattern formed on a photoconductive element; and control means for determining, during usual operation, an amount of toner to be replenished on the basis of a difference between an output of said toner content sensor and a reference value, and for forming, at a preselected timing, the reference pattern on the photoconductive element, detecting a density of the reference pattern via said pattern density sensor, and correcting said reference value in accordance with the density detected;

said control means correcting a determined amount of toner replenishment on the basis of sensitivity compensation data produced from the output of said toner content sensor.

* * * * *